US010994542B2

(12) United States Patent
Kurata et al.

(10) Patent No.: US 10,994,542 B2
(45) Date of Patent: May 4, 2021

(54) INKJET PRINTING APPARATUS

(71) Applicant: CANON KABUSHIKI KAISHA, Tokyo (JP)

(72) Inventors: Tetsuji Kurata, Yokohama (JP); Takuya Iwano, Inagi (JP); Hiromasa Amma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/531,765

(22) Filed: Aug. 5, 2019

(65) Prior Publication Data

US 2020/0047503 A1 Feb. 13, 2020

(30) Foreign Application Priority Data

Aug. 10, 2018 (JP) ..... JP2018-151445

(51) Int. Cl.
*B41J 2/165* (2006.01)

(52) U.S. Cl.
CPC ..... *B41J 2/16505* (2013.01); *B41J 2202/14* (2013.01); *B41J 2202/19* (2013.01)

(58) Field of Classification Search
CPC ..... B41J 2/16505; B41J 2202/14; B41J 2202/19; B41J 2/175; B41J 29/13; B41J 2/16585; B41J 2/1752; B41J 2/17553; B41J 2/1721; B41J 2/17509; B41J 29/02; B41J 29/17; B41J 2/18; B41J 2/16535; B41J 2/16517; B41J 2/17513; B41J 2/2114
See application file for complete search history.

(56) References Cited

U.S. PATENT DOCUMENTS

| | | | | |
|---|---|---|---|---|
| 5,398,049 | A | 3/1995 | Terasawa et al. | |
| 5,798,777 | A | 8/1998 | Yoshimura et al. | |
| 5,892,523 | A | 4/1999 | Tanaka et al. | |
| 6,471,315 | B1 | 10/2002 | Kurata | |
| 6,578,949 | B2 * | 6/2003 | Takahashi | B41J 2/16547 347/23 |

(Continued)

FOREIGN PATENT DOCUMENTS

| | | | |
|---|---|---|---|
| CN | 206812621 | U | 12/2017 |
| EP | 1 236 576 | A1 | 9/2002 |

(Continued)

OTHER PUBLICATIONS

Jan. 2, 2020 European Search Report in European Patent Appln. No. 19190308.7.

(Continued)

*Primary Examiner* — Thinh H Nguyen
(74) *Attorney, Agent, or Firm* — Venable LLP

(57) ABSTRACT

An inkjet printing apparatus includes a print head, to which a protective member configured to protect an ejection opening surface is attachable, and a head holder configured to hold the print head detachably. The inkjet printing apparatus further includes a guide portion provided in the head holder and configured to guide, in a width direction, the print head with the ejection opening surface protected by the protective member. The guide portion guides the print head with the protective member attached up to a predetermined position in the width direction and guides only the print head ahead of the predetermined position to prevent the protective member from exceeding the predetermined position.

20 Claims, 16 Drawing Sheets

(56) References Cited

U.S. PATENT DOCUMENTS

| | | | |
|---|---|---|---|
| 8,651,622 | B2 | 2/2014 | Oikawa et al. |
| 9,132,640 | B2 | 9/2015 | Wilson et al. |
| 9,802,426 | B2 | 10/2017 | Onuma et al. |
| 10,011,124 | B2 | 7/2018 | Ogasawara et al. |
| 10,071,572 | B2 | 9/2018 | Kurata et al. |
| 10,183,505 | B2 | 1/2019 | Ogasawara et al. |
| 2002/0036671 | A1 | 3/2002 | Takahashi et al. |
| 2012/0081491 | A1 | 4/2012 | Okumura |
| 2015/0202874 | A1 | 7/2015 | Wilson et al. |
| 2016/0207315 | A1 | 7/2016 | Tsuzawa |
| 2018/0015741 | A1 | 1/2018 | Onuma et al. |
| 2018/0339530 | A1 | 11/2018 | Kurata et al. |
| 2019/0283434 | A1 | 9/2019 | Kida et al. |
| 2019/0299681 | A1 | 10/2019 | Kurata et al. |

FOREIGN PATENT DOCUMENTS

| | | | |
|---|---|---|---|
| JP | 2001-063080 | A | 3/2001 |
| JP | 2003-127402 | A | 5/2003 |
| WO | 2014/042627 | A1 | 3/2014 |

OTHER PUBLICATIONS

Jan. 21, 2021 Chinese Official Action in Chinese Patent Appln. No. 201910721428.8.

JP 2003-127402 A, Cited in Jan. 8, 2020 IDS.

EP 1236576 A1, Cited in Jan. 8, 2020 IDS.

U.S. 2016/0207315 A1, Cited in Jan. 8, 2020 IDS.

U.S. 2012/0081491 A1, Cited in Jan. 8, 2020 IDS.

JP 2001-063080 A, Cited in Aug. 5, 2019 IDS.

U.S. 2002/0036671 A1.

CN 206812621 U.

WO 2014/042627 A1. U.S. 2015/0202874 A1, U.S. Pat. No. 9,132,640 B2.

U.S. Pat. No. 5,798,777.

* cited by examiner

INKJET PRINTING APPARATUS

BACKGROUND OF THE INVENTION

Field of the Invention

The present invention relates to an inkjet printing apparatus comprising a print head that ejects ink to print an image.

Description of the Related Art

Japanese Patent Laid-Open No. 2001-63080 discloses a cover for protecting an ejection opening surface of an inkjet print head attachable to and detachable from an apparatus body. According to Japanese Patent Laid-Open No. 2001-63080, at the time of replacement of the print head, a user removes the cover from the print head and attaches the print head without the cover to the apparatus.

However, in the configuration disclosed in Japanese Patent Laid-Open No. 2001-63080, a user manually removes the cover and attaches the print head. This raises the possibility that the ejection opening surface exposed after the removal of the cover is damaged at the time of attachment of the print head. In particular, in the case of a relatively large print head to be attached to a full line printing apparatus, since the ejection opening surface has a large area and the print head is heavy, there is a high possibility that the ejection opening surface contacts another object at the time of replacement of the print head.

SUMMARY OF THE INVENTION

The present invention has been accomplished in order to solve the above problem. Thus, an object is to provide an inkjet printing apparatus that is capable of suppressing damage to an ejection opening surface at the time of replacement of a print head and attaching the print head to a suitable position with a simplified configuration.

In an aspect of the present invention, there is provided an inkjet printing apparatus comprising: a print head comprising an ejection opening surface on which ejection openings configured to eject ink are arrayed in a width direction of a printing medium; a protective member configured to protect the ejection opening surface being detachably attached to the print head; a head holder configured to hold the print head detachably; and a guide portion provided in the head holder and configured to guide the print head to which the protective member is attached toward a predetermined position in the width direction, wherein the guide portion guides the print head downstream of the predetermined position and prevents the protective member from exceeding the predetermined position.

Further features of the present invention will become apparent from the following description of exemplary embodiments with reference to the attached drawings.

DESCRIPTION OF THE EMBODIMENTS

Figure 1:
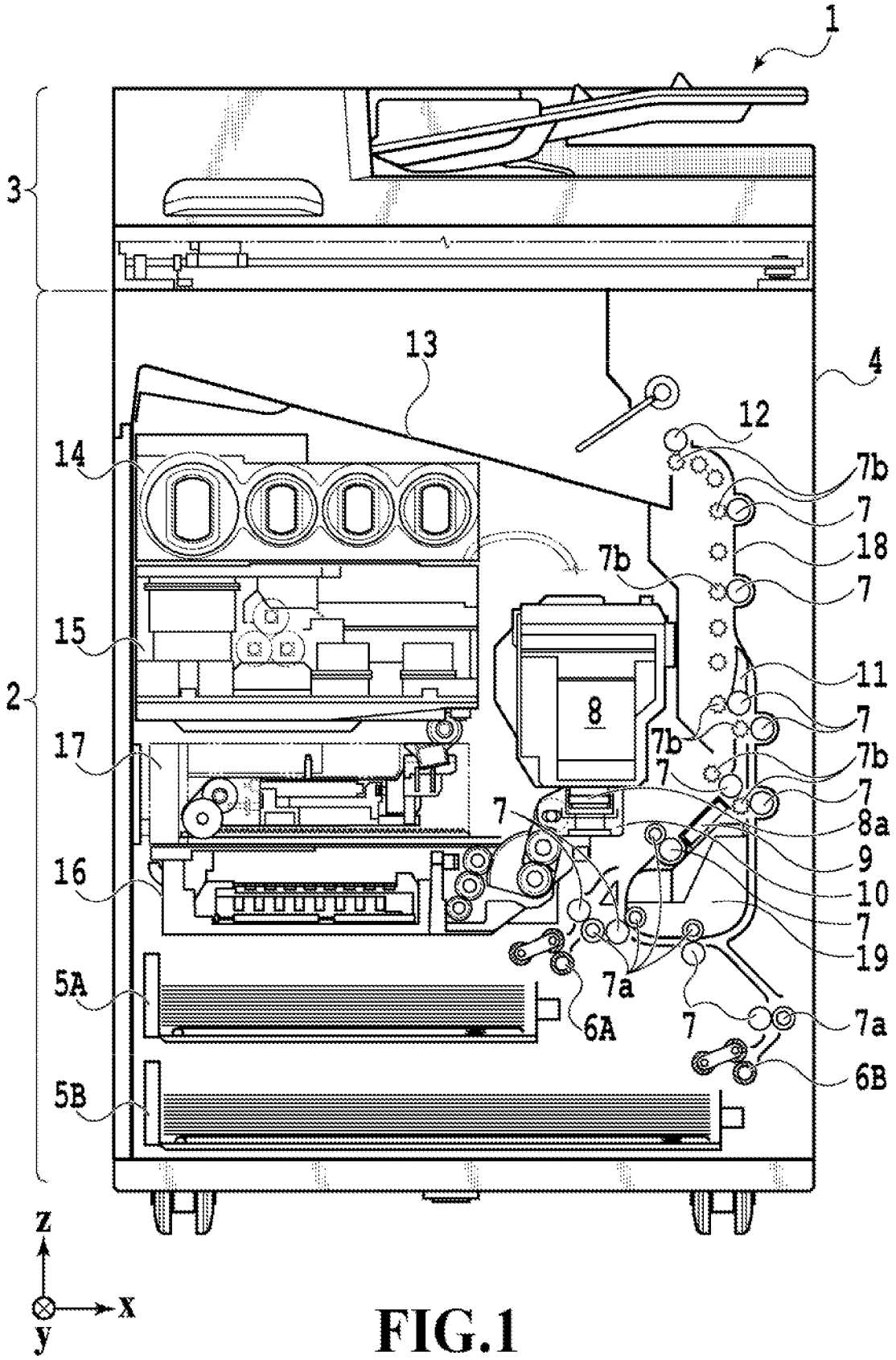
FIG. 1 is a diagram of a printing apparatus in a standby state.

FIG. 1 is an internal configuration diagram of an inkjet printing apparatus 1 (hereinafter "printing apparatus 1") used in the present embodiment. In the drawings, an x direction is a horizontal direction, a y direction (a direction perpendicular to paper) is a direction in which ejection openings are arrayed in a print head 8 described later, and a z direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a printing medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a printing medium S in a predetermined direction. The conveying rollers 7 are drive rollers located upstream and downstream of the print head 8 and driven by a conveying motor (not shown). The pinch rollers 7*a* are follower rollers that are turned while nipping a printing medium S together with the conveying rollers 7. The discharging roller 12 is a drive roller located downstream of the conveying rollers 7 and driven by the conveying motor (not shown). The spurs 7*b* nip and convey a printing medium S together with the conveying rollers 7 and discharging roller 12 located downstream of the print head 8.

The guide 18 is provided in a conveying path of a printing medium S to guide the printing medium S in a predetermined direction. The inner guide 19 is a member extending in the y direction. The inner guide 19 has a curved side surface and guides a printing medium S along the side surface. The flapper 11 is a member for changing a direction in which a printing medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y direction in FIG. 1 so as to correspond to the width of a printing medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y direction and supports a printing medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
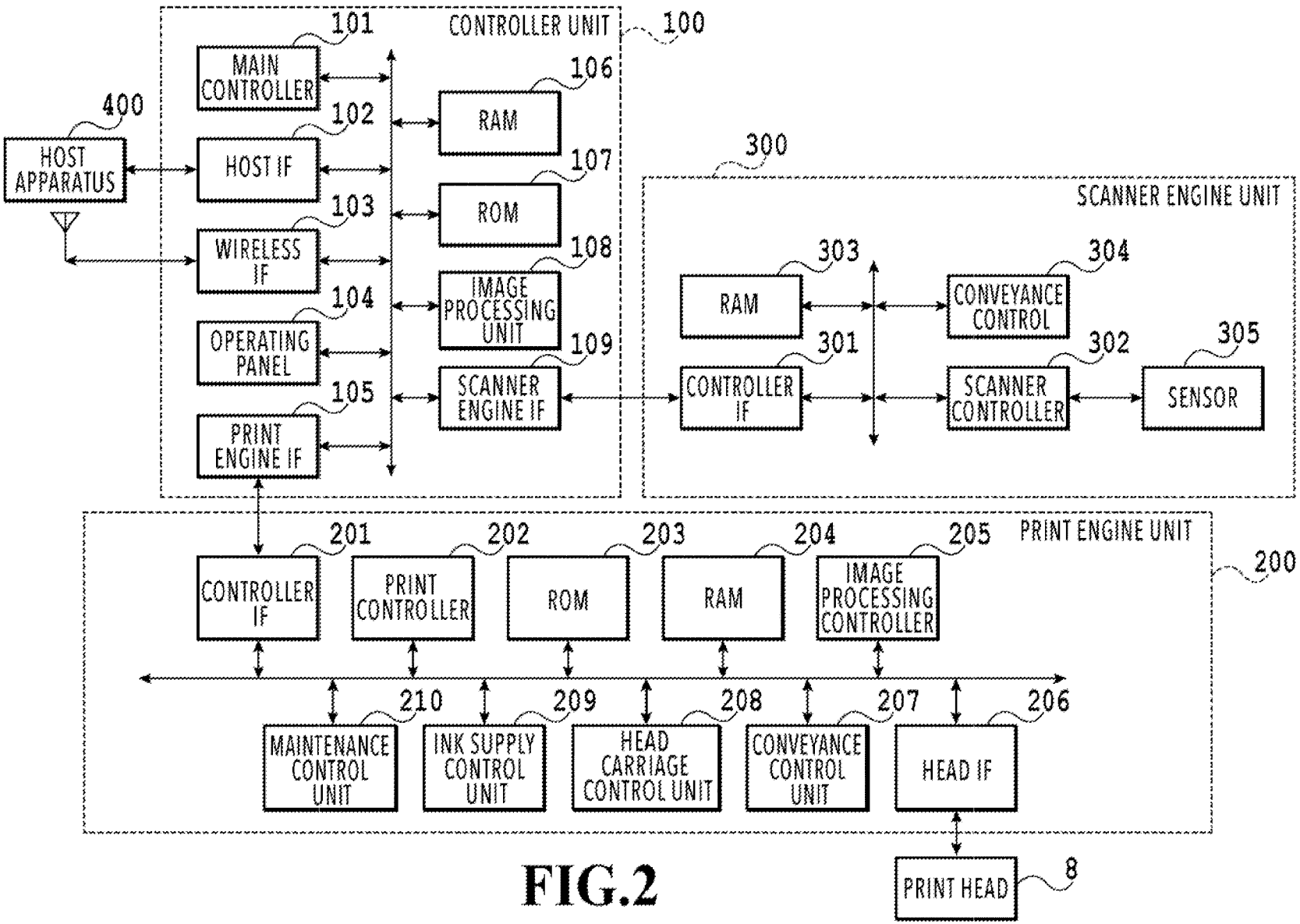
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a printing medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the printing medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
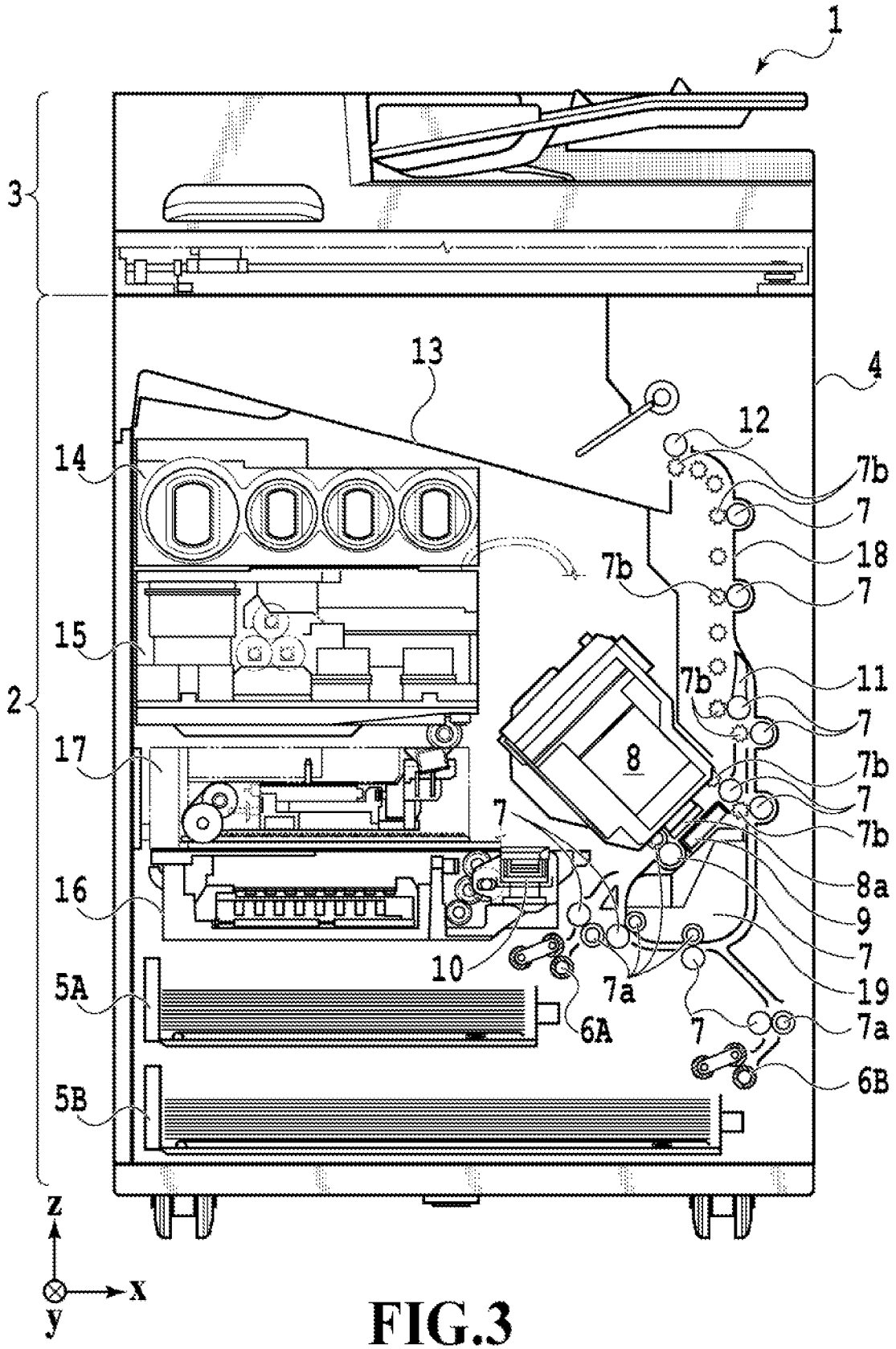
FIG. 3 is a diagram of the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a printing medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a printing medium S.

Figure 4C:
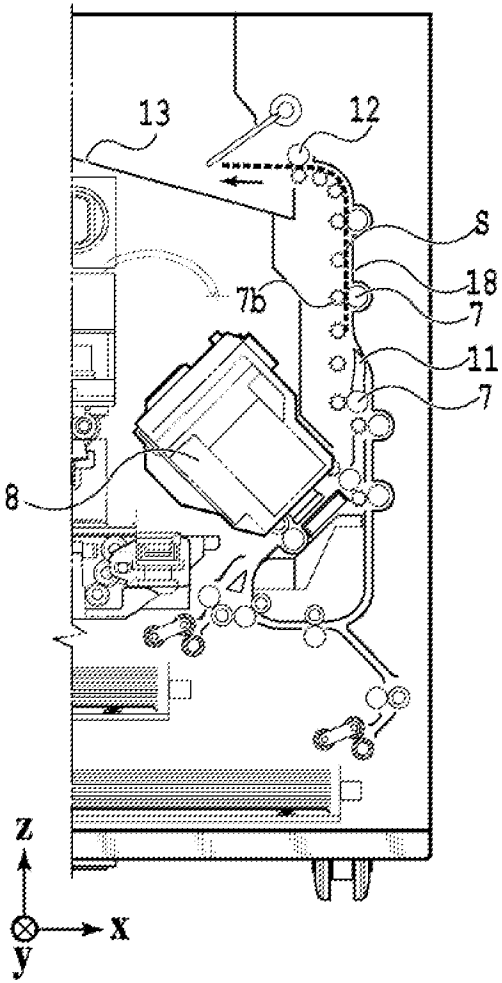
FIGS. 4A to 4C are diagrams of a conveying path of a printing medium conveyed from a first cassette.
Figure 4B:
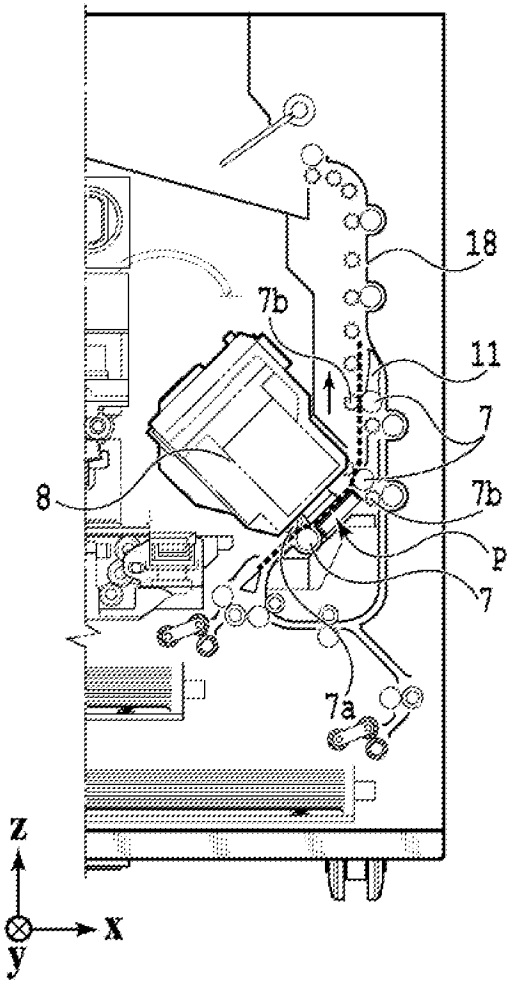
Figure 4A:
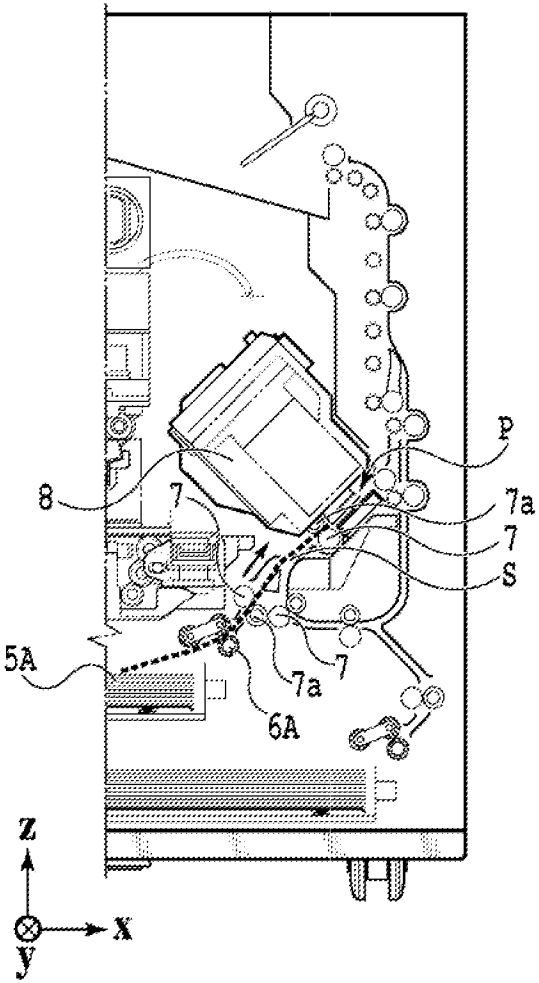

FIGS. 4A to 4C are diagrams showing a conveying path in the case of feeding an A4 size printing medium S from the first cassette 5A. A printing medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the printing medium S is about to reach the print area P. The direction of movement of the printing medium S is changed from the horizontal direction (x direction) to a direction inclined about 45° with respect to the horizontal direction while being fed by the first feeding unit 6A to reach the print area P.

In the print area P, a plurality of ejection openings provided in the print head 8 eject ink toward the printing medium S. In an area where ink is applied to the printing medium S, the back side of the printing medium S is supported by the platen 9 so as to keep a constant distance between the ejection opening surface 8*a* and the printing medium S. After ink is applied to the printing medium S, the conveying rollers 7 and the spurs 7*b* guide the printing medium S such that the printing medium S passes on the left of the flapper 11 with its tip inclined to the right and is conveyed along the guide 18 in the vertically upward direction of the printing apparatus 1. FIG. 4B shows a state where the front end of the printing medium S has passed through the print area P and the printing medium S is being conveyed vertically upward. The conveying rollers 7 and the spurs 7*b* change the direction of movement of the printing medium S from the direction inclined about 45° with respect to the horizontal direction in the print area P to the vertically upward direction.

After being conveyed vertically upward, the printing medium S is discharged into the discharging tray 13 by the discharging roller 12 and the spurs 7*b*. FIG. 4C shows a state where the front end of the printing medium S has passed through the discharging roller 12 and the printing medium S is being discharged into the discharging tray 13. The discharged printing medium S is held in the discharging tray 13 with the side on which an image was printed by the print head 8 down.

Figure 5C:
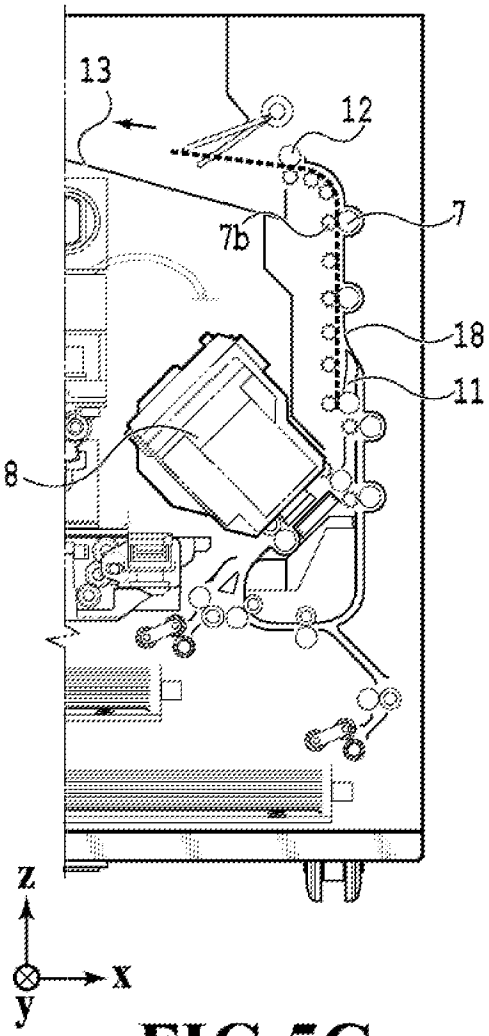
FIGS. 5A to 5C are diagrams of a conveying path of a printing medium conveyed from a second cassette.
Figure 5B:
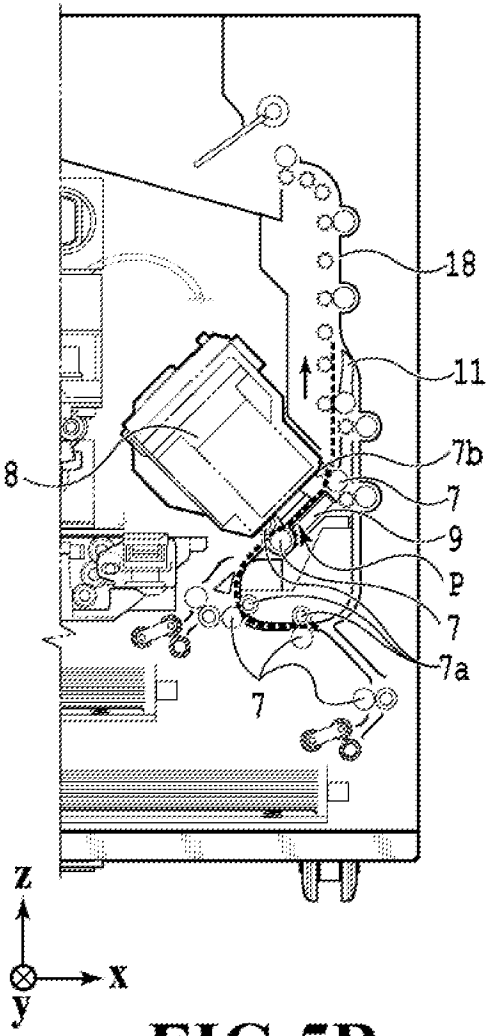
Figure 5A:
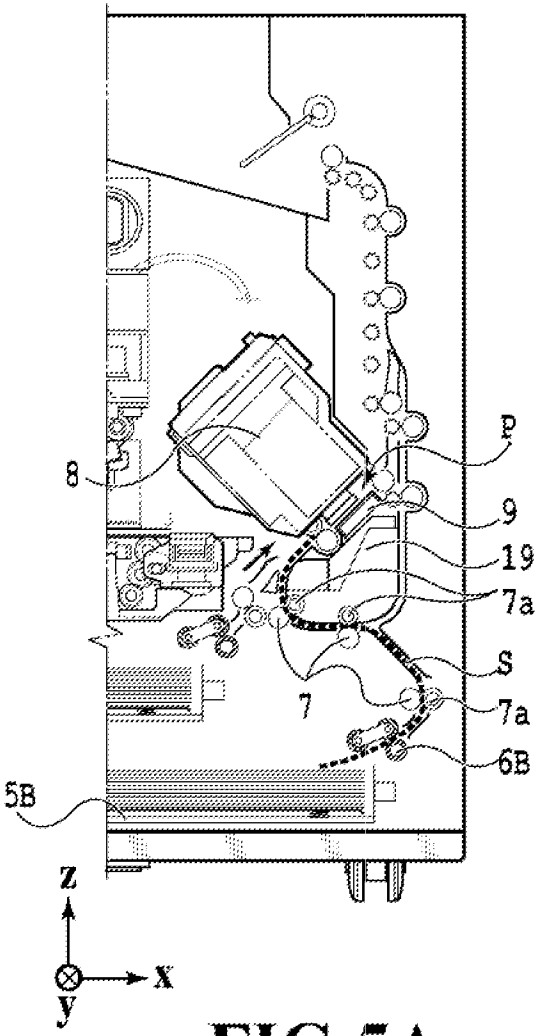

FIGS. 5A to 5C are diagrams showing a conveying path in the case of feeding an A3 size printing medium S from the second cassette 5B. A printing medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the printing medium S is about to reach the print area P. In a part of the conveying path, through which the printing medium S is fed by the second feeding unit 6B toward the print area P, the plurality of conveying rollers 7, the plurality of pinch rollers 7*a*, and the inner guide 19 are provided such that the printing medium S is conveyed to the platen 9 while being bent into an S-shape.

The rest of the conveying path is the same as that in the case of the A4 size printing medium S shown in FIGS. 4B and 4C. FIG. 5B shows a state where the front end of the printing medium S has passed through the print area P and the printing medium S is being conveyed vertically upward. FIG. 5C shows a state where the front end of the printing medium S has passed through the discharging roller 12 and the printing medium S is being discharged into the discharging tray 13.

FIGS. 6A to 6D show a conveying path in the case of performing print operation (duplex printing) for the back side (second side) of an A4 size printing medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
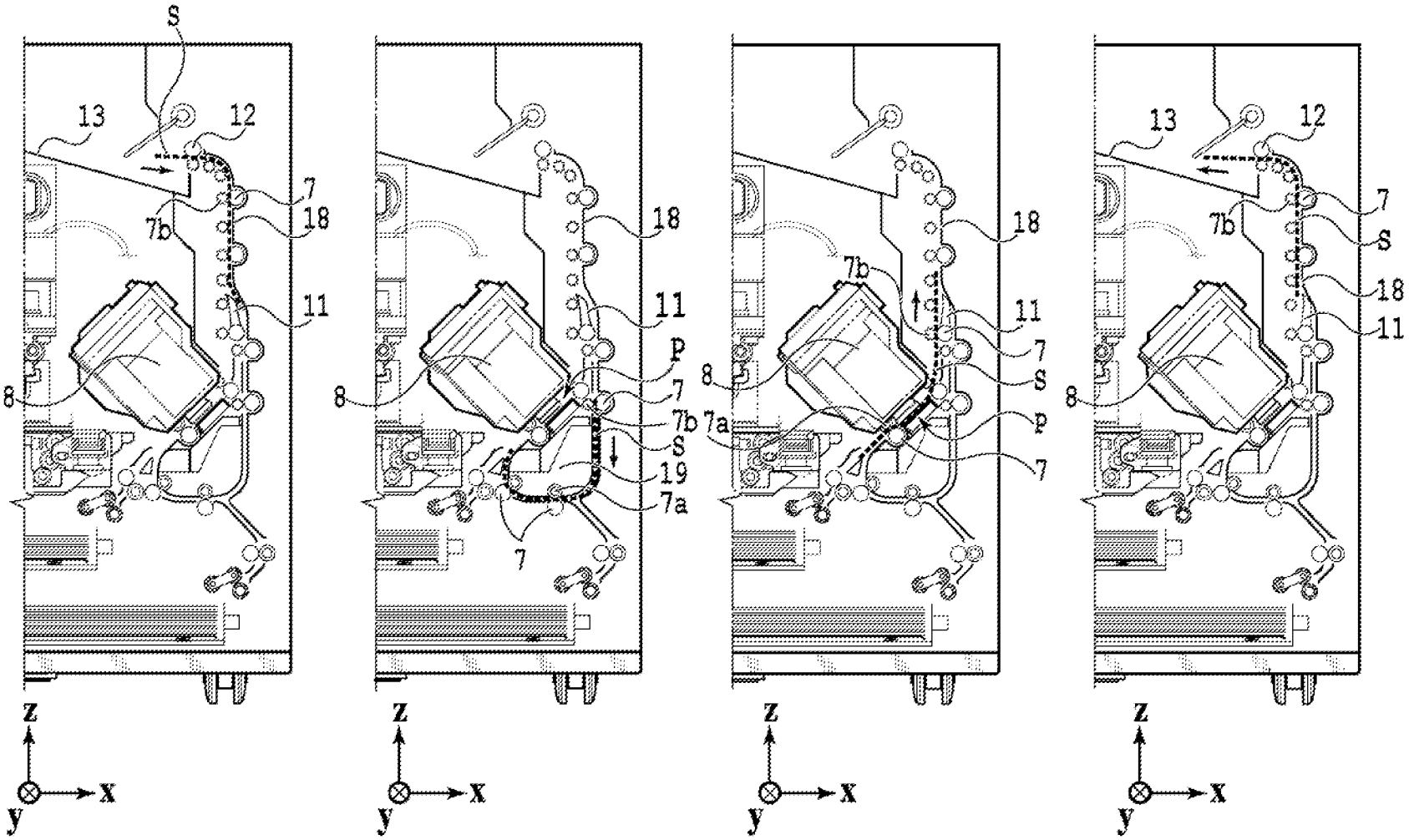
FIGS. 6A to 6D are diagrams of a conveying path in the case of performing print operation for the back side of a printing medium.

After the print head 8 finishes print operation for the first side and the back end of the printing medium S passes by the flapper 11, the print controller 202 turns the conveying rollers 7 backward to convey the printing medium S into the printing apparatus 1. At this time, since the flapper 11 is controlled by an actuator (not shown) such that the tip of the flapper 11 is inclined to the left, the front end of the printing medium S (corresponding to the back end during the print operation for the first side) passes on the right of the flapper 11 and is conveyed vertically downward. FIG. 6A shows a state where the front end of the printing medium S (corresponding to the back end during the print operation for the first side) is passing on the right of the flapper 11.

Then, the printing medium S is conveyed along the curved outer surface of the inner guide 19 and then conveyed again to the print area P between the print head 8 and the platen 9. At this time, the second side of the printing medium S faces the ejection opening surface 8*a* of the print head 8. FIG. 6B shows a conveying state where the front end of the printing medium S is about to reach the print area P for print operation for the second side.

The rest of the conveying path is the same as that in the case of the print operation for the first side shown in FIGS. 4B and 4C. FIG. 6C shows a state where the front end of the printing medium S has passed through the print area P and the printing medium S is being conveyed vertically upward.

At this time, the flapper 11 is controlled by the actuator (not shown) such that the tip of the flapper 11 is inclined to the right. FIG. 6D shows a state where the front end of the printing medium S has passed through the discharging roller 12 and the printing medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
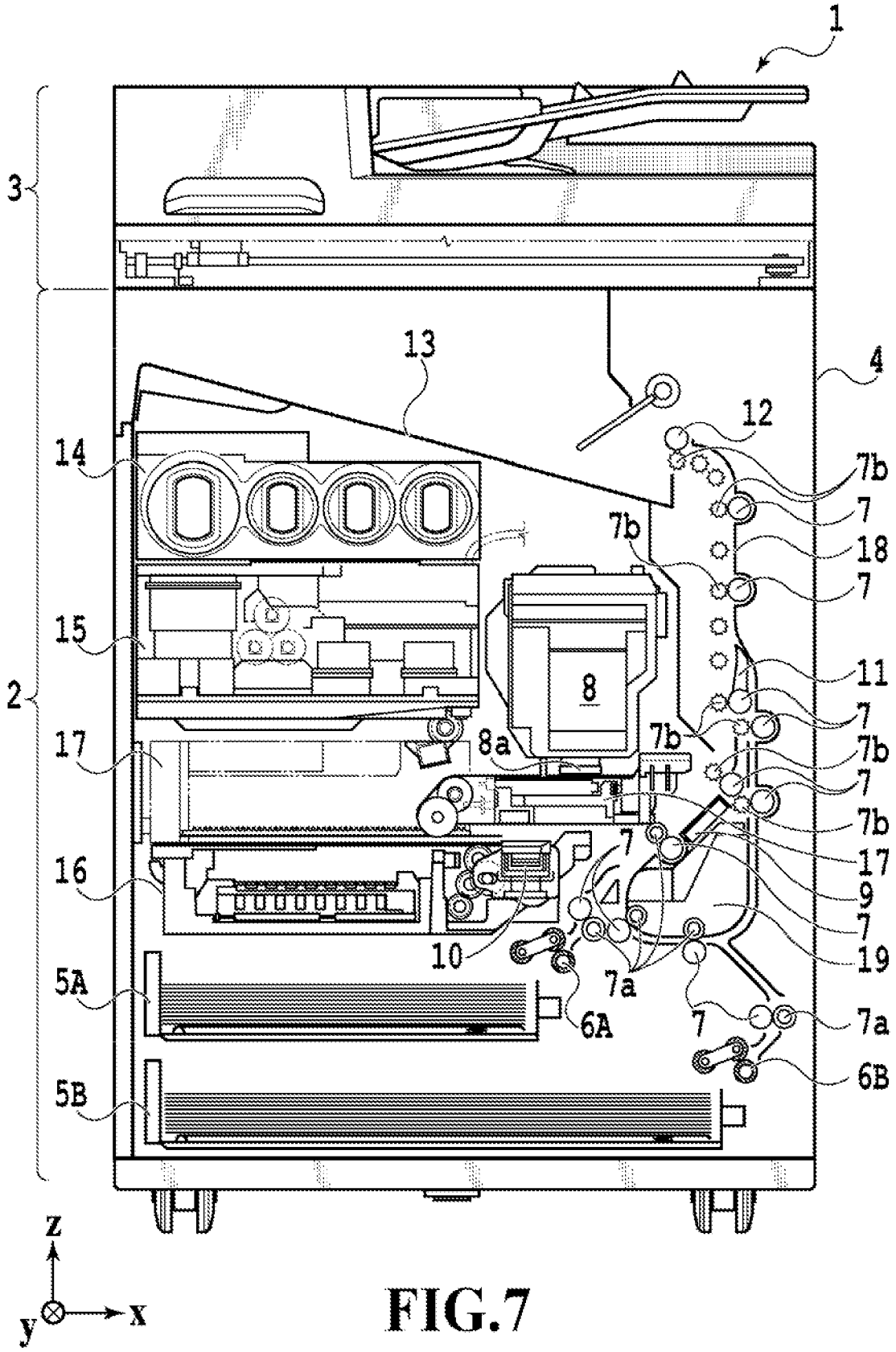
FIG. 7 is a diagram of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8:
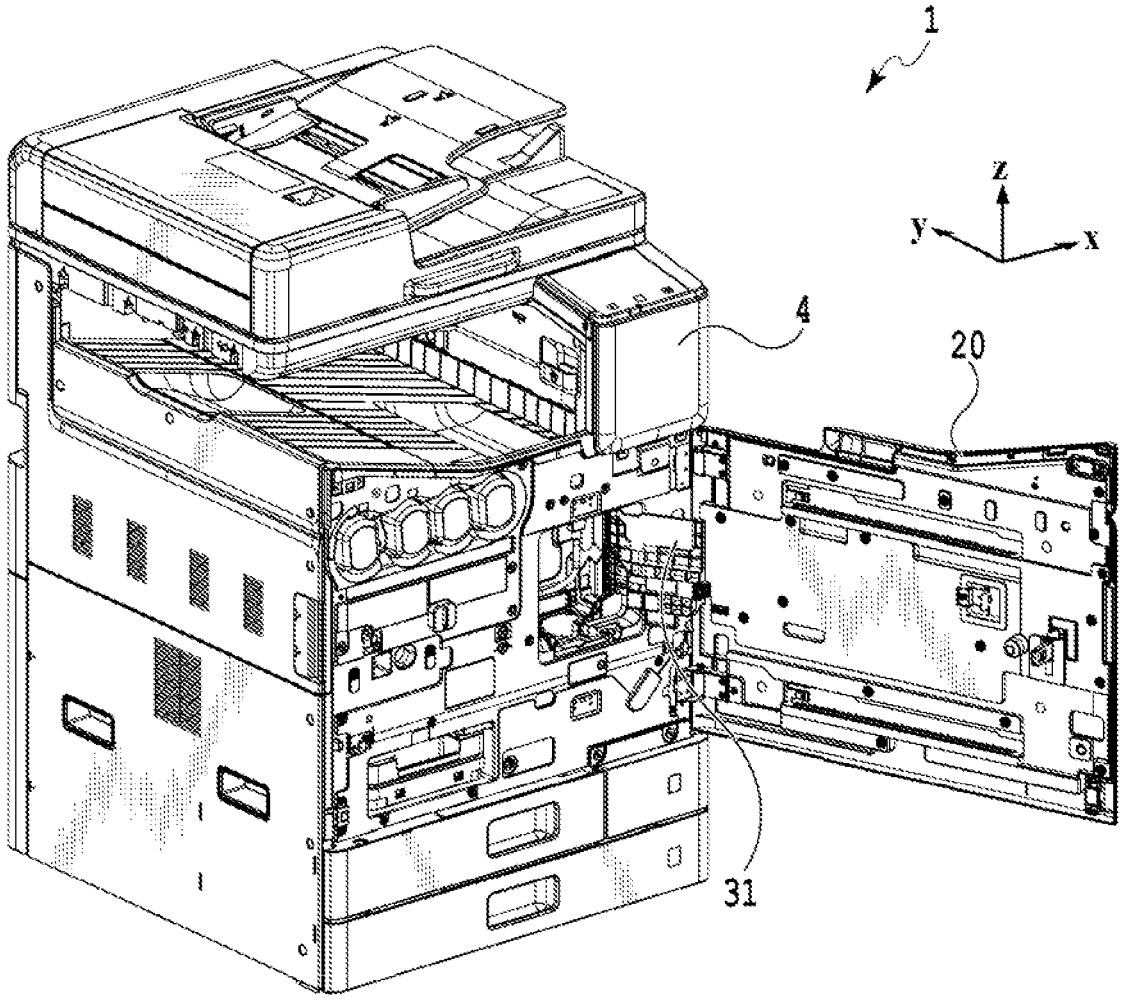
FIG. 8 is an external perspective view of the printing apparatus.

FIG. 8 is an external perspective view of the printing apparatus 1, showing a state where a front door 20 and a head holder door 31 openable and closable by a user are both open. The print head 8 of the present embodiment is replaceable in the printing apparatus 1. In the case of replacing the print head 8, a user first opens the front door 20 at the front of the apparatus as illustrated and then opens the head holder door 31 located inside. After that, a user inserts the print head 8 into a head holder 30 provided inside the head holder door 31 from front to back in a +y direction in the drawing.

Figure 9:
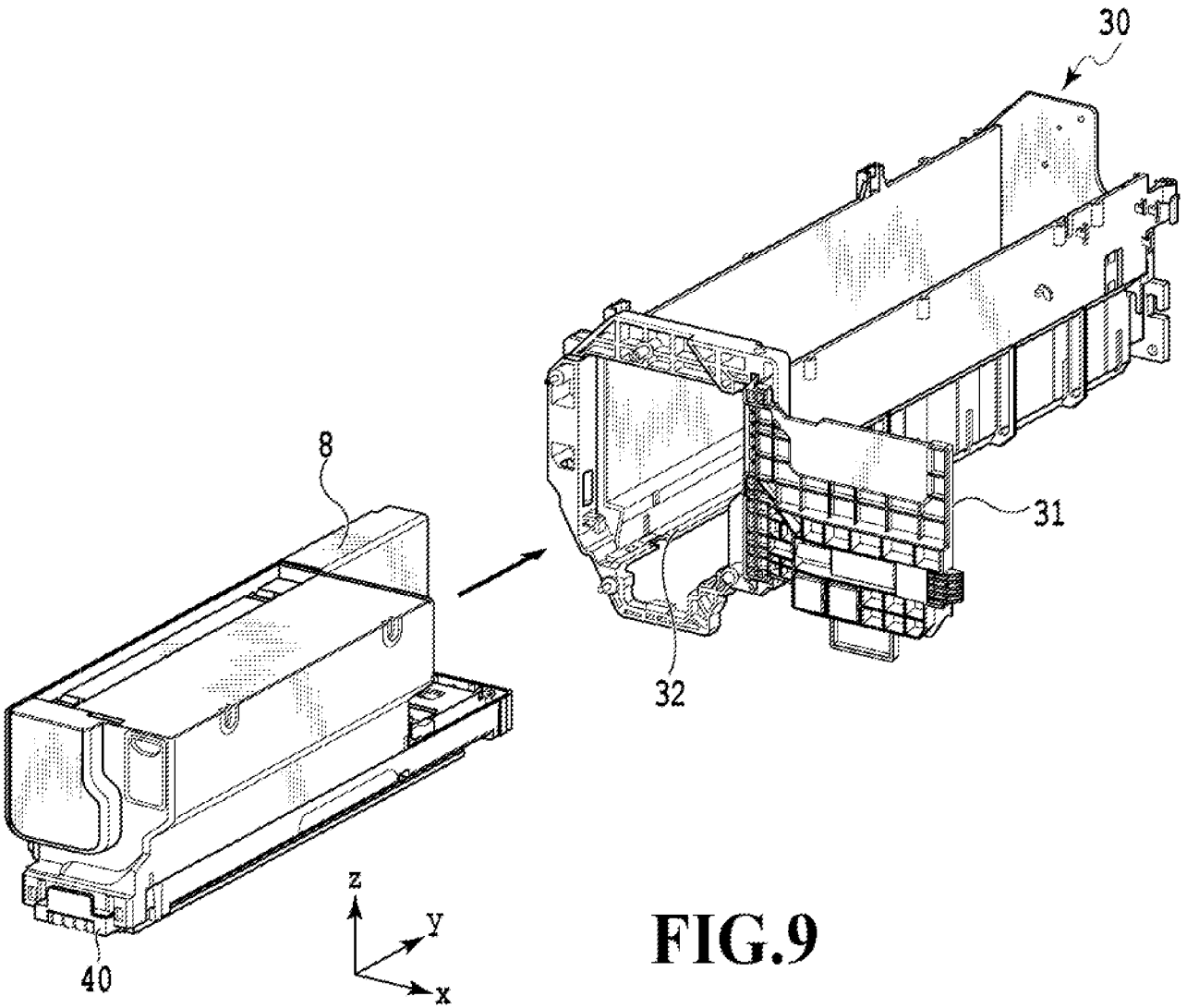
FIG. 9 is a diagram showing a state where a print head is inserted into a head holder.

FIG. 9 is a diagram showing a state where the print head 8 is inserted into the head holder 30. The head holder 30 has a shape capable of accommodating the entire print head 8. A position in the head holder 30 corresponding to the ejection opening surface 8*a* of the print head 8 is provided with an opening for exposing the ejection opening surface 8*a*. A user inserts the print head 8 placed on a sliding bottom surface 32 of the head holder 30, checks that the print head 8 abuts on the end, and then closes the head holder door 31.

In the description below, an x direction is a lateral direction of the print head 8 (direction of the side surface), a y direction is a longitudinal direction of the print head 8 (width direction of a printing medium), and a z direction is an ejection direction of the print head 8. As described above, the print head 8 of the present embodiment is turnable inside the printing apparatus 1 and x, y, and z axes of the print head do not always correspond to the x, y, and z axes of the printing apparatus 1, but basically correspond to the x, y, and z axes in the standby state shown in FIG. 1.

Figure 10A:
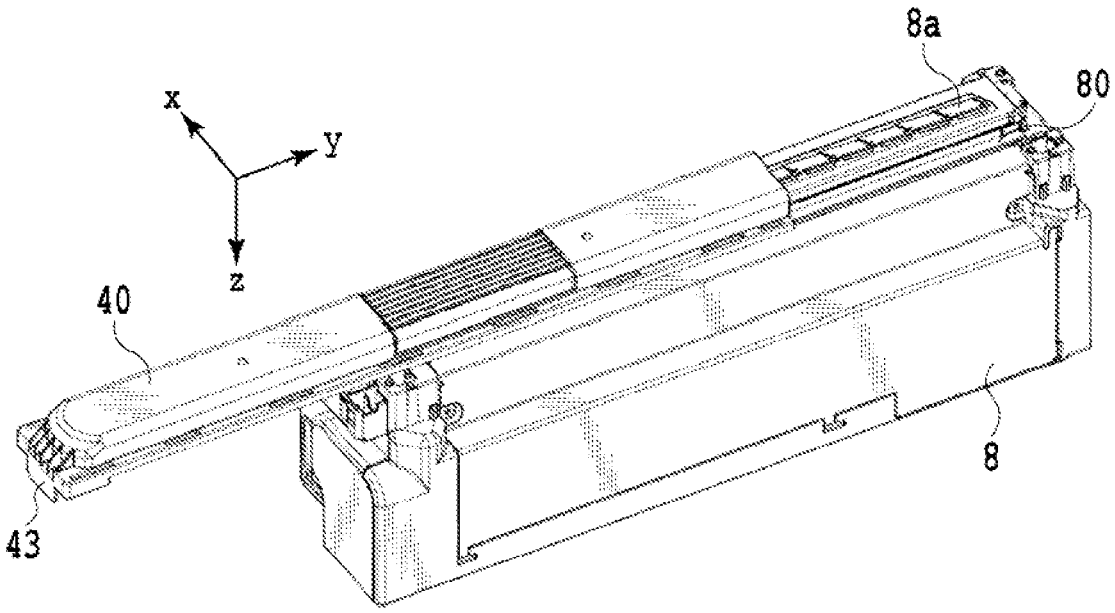
FIGS. 10A and 10B are diagrams showing states of attachment of a protective member to the print head.
Figure 10B:
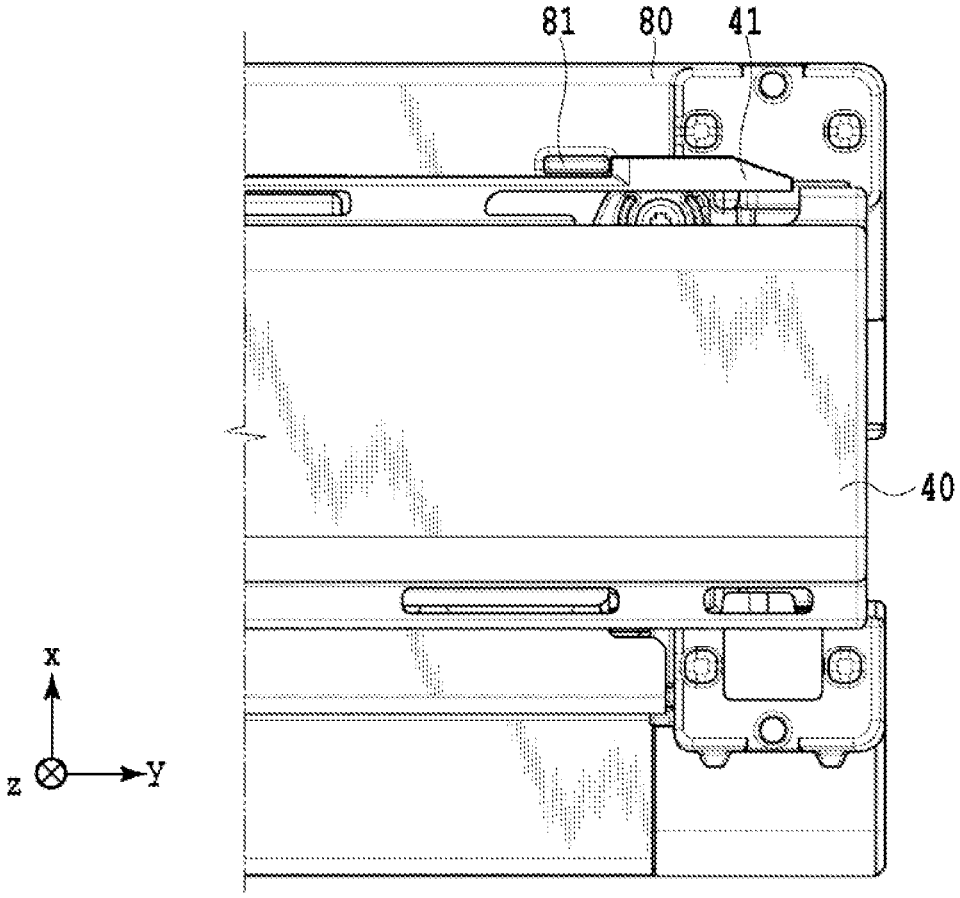

FIGS. 10A and 10B diagrams showing states of attachment of a protective member (cover) 40 to the print head 8. FIGS. 10A and 10B show the print head 8 from the ejection opening surface 8*a* side. As shown in FIG. 10A, the protective member 40 has a shape slidable in the longitudinal direction (y direction) while covering the ejection opening surface 8*a*. The protective member 40 slides rightward in the drawing along a base plate 80 of the print head 8 extending in the longitudinal direction and is fixed at the end of the base plate 80. The left end of the protective member 40 is provided with a stopper 43 for restricting sliding of the protective member 40.

FIG. 10B is a diagram showing a state where the protective member 40 is fixed to the print head 8. The end of the protective member 40 in the sliding direction (+y direction) is provided with a claw-shaped locking member 41 having a tapered surface and turnable by a force in the lateral direction (−x direction in the drawing). The base plate 80 of the print head 8 is provided with an engagement portion 81 in a position through which the locking member 41 passes. Under this configuration, as the protective member 40 slides in the +y direction and the tapered surface of the locking member 41 abuts on the engagement portion 81, the locking member 41 is turned clockwise in FIG. 10B by a force in the −x direction. With the locking member 41 turned, the protective member 40 proceeds in the y direction. After the locking member 41 slides in the +y direction to a position beyond the engagement portion 81, the locking member 41 is turned counterclockwise to the original position as shown in FIG. 10B.

In the state shown in FIG. 10B, the left end of the locking member 41 is in contact with the right end of the engagement portion 81 and the leftward (−y direction) movement of the protective member 40 is restricted. The stopper 43 shown in FIG. 10A is in contact with the left end of the base plate 80 and the rightward (+y direction) movement of the protective member 40 is also restricted. That is, in a state where the locking member 41 and the engagement portion 81 are engaged as shown in FIG. 10B, the protective member 40 is fixed to the print head 8 and the ejection opening surface 8*a* is protected by the protective member 40. Since the protective member 40 is locked by the locking member 41, a user cannot remove the protective member 40 before attachment of the print head 8 to the printing apparatus 1. In this manner, the print head 8 of the present embodiment is transported to a user with the ejection opening surface 8*a* protected by the protective member 40.

Figure 11A:
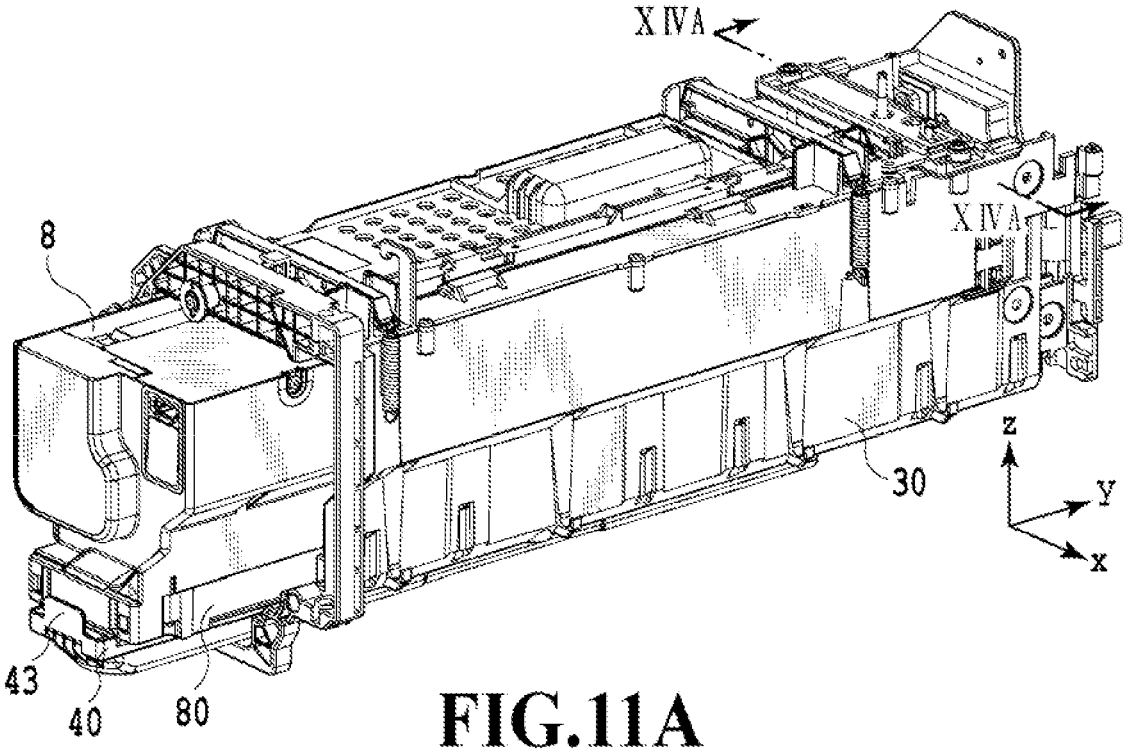
FIGS. 11A and 11B are diagrams showing states of attachment of the print head to the head holder.
Figure 11B:
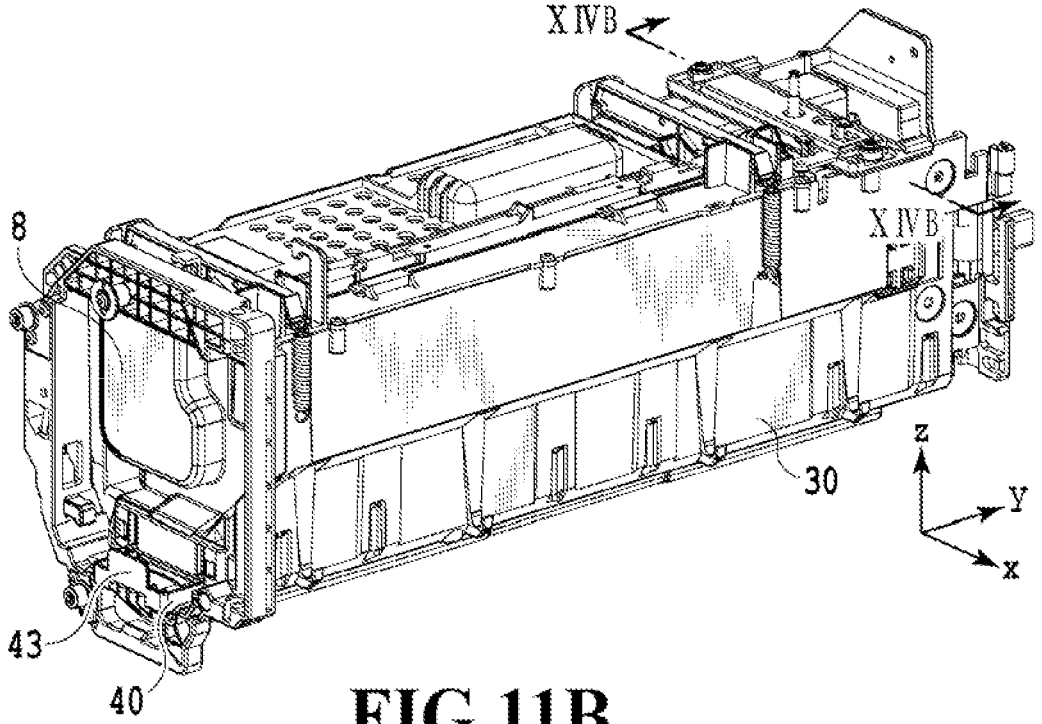

FIGS. 11A and 11B are diagrams showing states of attachment of the print head 8 to the head holder 30. FIG. 11A shows a state where the print head 8 is being inserted into the head holder 30. FIG. 11B shows a state where the print head 8 has been inserted up to a fixed position. In both of the drawings, the head holder door 31 is omitted.

The print head 8 of the present embodiment is inserted into the head holder 30 by a user with the protective member 40 attached. During the process of the insertion, the protective member 40 is mechanically removed from the print head 8.

Figure 12A:
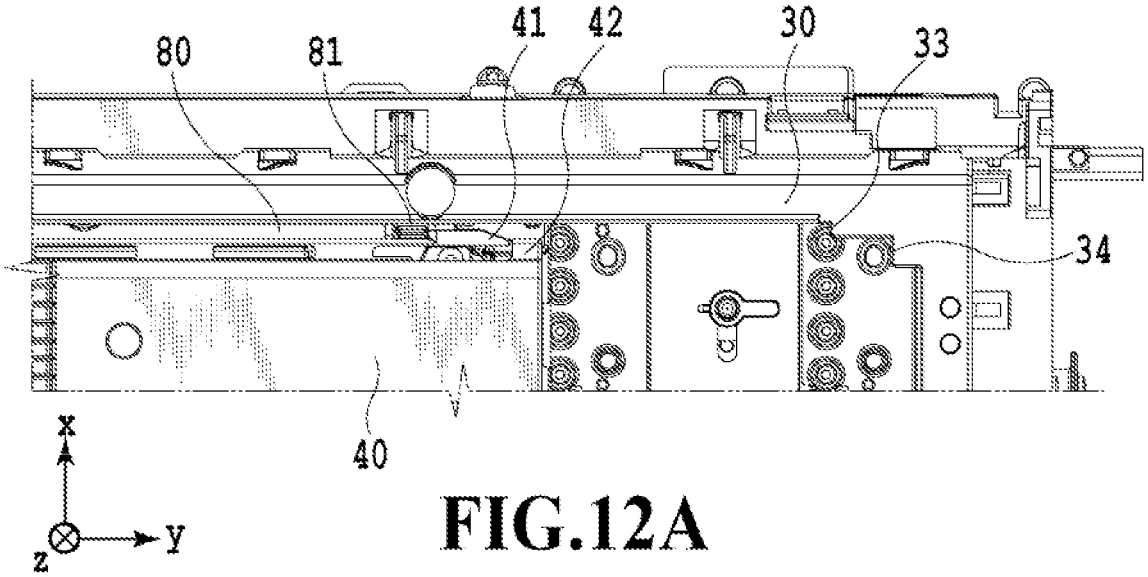
FIGS. 12A to 12C are diagrams showing a mechanism of removal of the protective member from the print head.
Figure 12B:
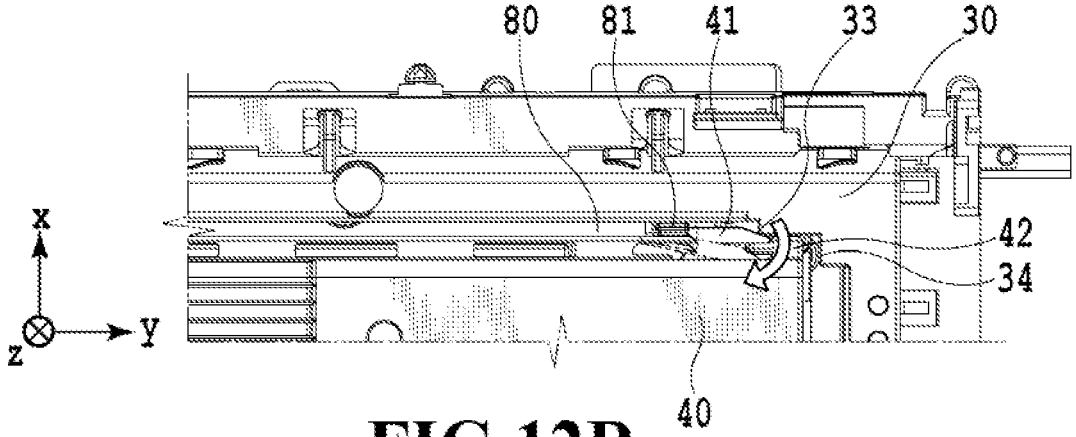
Figure 12C:
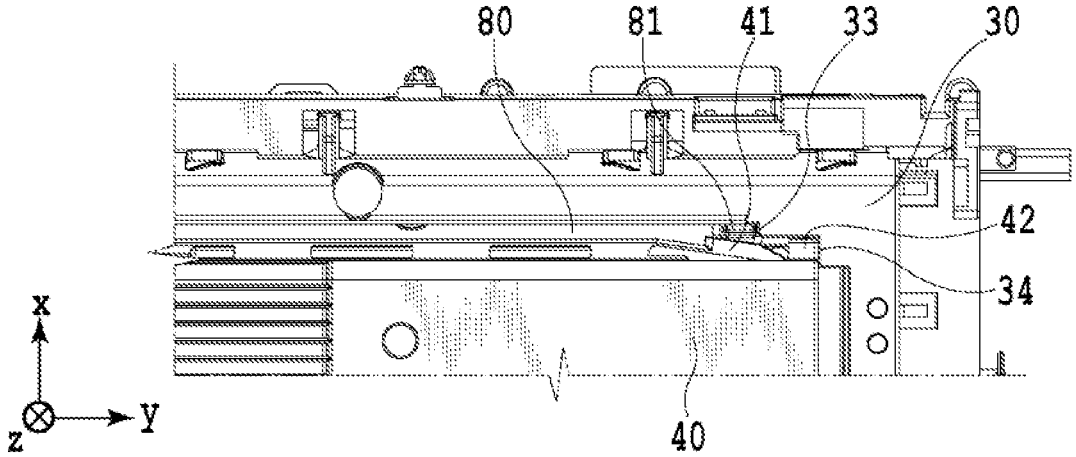

FIGS. 12A to 12C are diagrams showing a mechanism of removal of the protective member 40 from the print head 8 along with the insertion of the print head 8. In FIGS. 12A to 12C, the print head 8 is inserted and moved from left to right into the head holder 30.

As shown in FIG. 12A, the locking member 41 and the engagement portion 81 move rightward while maintaining the engagement state shown in FIG. 10B. In the direction of movement (y direction), a first pressing member 33 is provided in a position in the base plate 80 facing the locking member 41. In the protective member 40, a protective member end 42 is provided in a position ahead of the locking member 41 in the direction of movement (y direction). A second pressing member 34 is provided in a position in the base plate 80 facing the protective member end 42.

FIG. 12B shows a state where the locking member 41 is in contact with the first pressing member 33. As the tapered surface of the locking member 41 contacts the first pressing member 33, the locking member 41 is turned clockwise by a force inward in the lateral direction (−x direction) and a space through which the engagement portion 81 can pass is formed outside the locking member 41 (+x side).

FIG. 12C shows a state where the engagement portion 81 moves rightward through the space formed by turning the locking member 41 and the protective member end 42 is in contact with the second pressing member 34. The protective member end 42 contacts the second pressing member 34, thereby restricting the movement of the protective member 40 in the y direction. On the other hand, since the engagement portion 81 and the locking member 41 are disengaged, the protective member 40 is removed from the print head 8, which enables only the print head 8 to further proceed in the y direction. That is, the protective member 40 will not be inserted ahead of the position shown in FIG. 12C. The print head 8 is positioned with respect to the head holder 30 further downstream in the y direction.

That is, the locking member 41 contacts the first pressing member 33 and is turned, whereby the protective member 40 is disengaged from the engagement portion 81, and after that, the protective member end 42 contacts the second pressing member 34 and the movement of the protective member 40 is restricted, whereby the protective member 40 is removed from the print head 8. Further insertion of the print head 8 forms a gap between the stopper 43 of the protective member 40 and the print head 8. This enables a user to use the stopper 43 as a gripping portion to pull the protective member 40 frontward (outside the apparatus) (see FIG. 11B).

As described above, according to the present embodiment, the protective member 40 can be detached from the print head 8 only after a user inserts, into the head holder 30, the print head 8 with the protective member 40 attached. That is, a user does not need to touch the protective member 40 to detach the protective member 40 from the print head 8, which reduces the possibility that the print head 8 is attached after the protective member 40 is accidentally removed. Accordingly, the print head can be attached to a suitable position with a simplified configuration without concern about contamination or damage caused by contact between liquid on the ejection opening surface of the print head 8 and another object.

Figure 13:
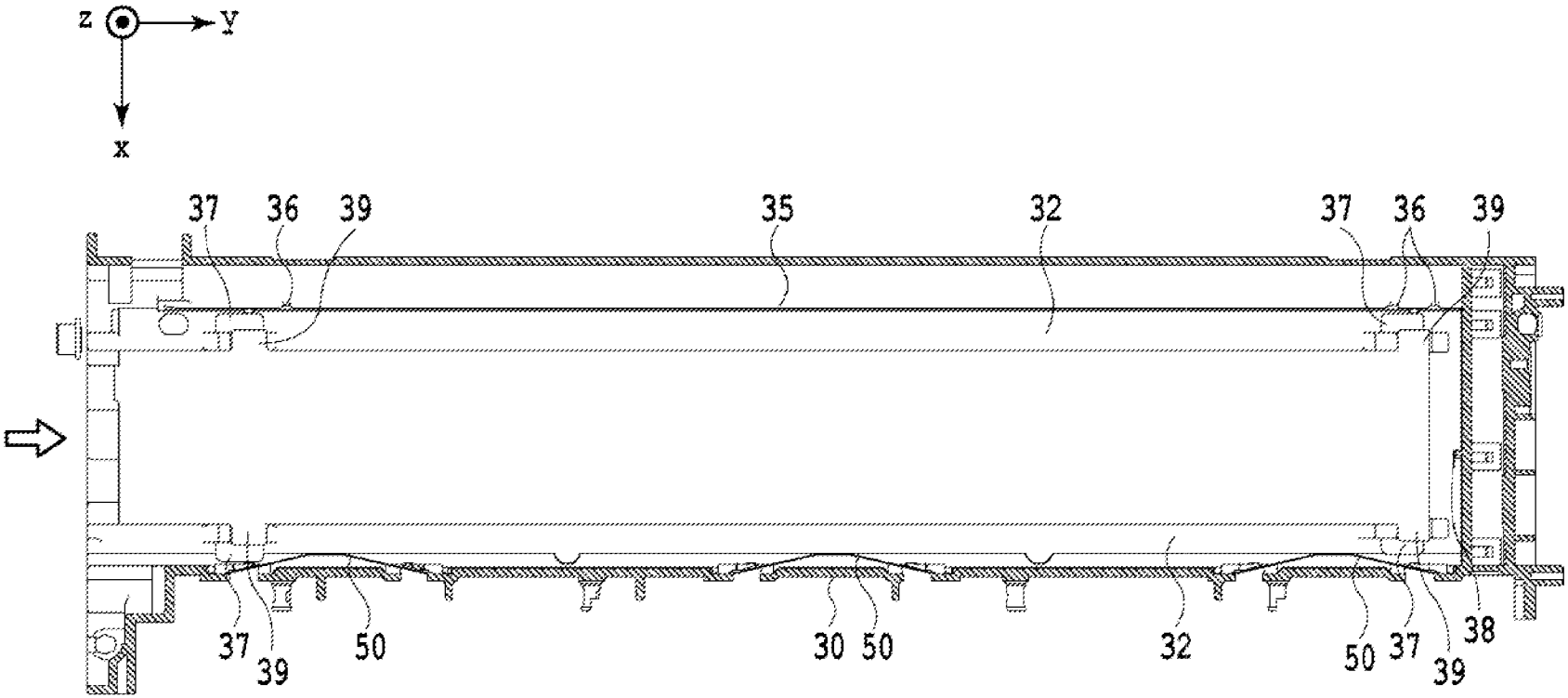
FIG. 13 is a diagram showing the head holder from above.

Next, the positioning of the print head 8 inside the head holder 30 will be described. FIG. 13 is a diagram showing the head holder 30 without the print head 8, as viewed from above (+z side).

Both ends of the opening of the head holder 30 in the lateral direction are provided with a sliding bottom surface 32 extending in they direction. The print head 8 is inserted in the +y direction while sliding on the sliding bottom surfaces 32. That is, the sliding bottom surface 32 serves as a guide portion for guiding the print head 8 in the +y direction of the head holder 30. Both ends of the sliding bottom surface 32 in the ±x direction and both ends of the sliding bottom surface 32 in the ±y direction are provided with a cut-off portion 39 cut off so as not to contact a sliding portion (not shown in FIG. 13) of the print head 8. A landing surface 37 is provided further outside the cut-off portion 39 in the ±x direction so as to guide and position the print head 8 in the z direction (direction of gravity) in the head holder 30.

One of the inner walls of the head holder 30 extending in the y direction is provided with three urging members 50 formed from leaf springs, and the other is provided with a sliding side surface 35 formed from a flat plate. Accordingly, the print head 8 inserted into the head holder 30 proceeds in the y direction while being urged by the urging member 50 in the −x direction (direction of the side surface) in the drawing and guided by the sliding side surface 35. Both ends of the sliding side surface 35 in the ±y direction are provided with a recess 36 having a shape recessed so as not to contact a protrusion 84 (not shown in FIG. 13) formed on the side surface of the base plate 80. On the sliding side surface 35, a positioning rib 360 (see FIGS. 16A to 16D) is formed near the recess 36 for positioning the print head 8 in the x direction. The urging member 50 and the positioning rib 360 described above are features for positioning the print head 8 in the x direction while guiding the print head 8 in the y direction in the head holder 30.

Further, one of the inner walls of the head holder 30 extending in the x direction on the back side (surface on the downstream side in the +y direction) is provided with a rib-shaped front positioning member 38 so as to contact the inserted print head 8. The end of the base plate 80 of the inserted print head 8 abuts on the front positioning member 38 and a user further closes the head holder door 31 described with reference to FIG. 8 and FIG. 9, whereby the position of the print head 8 in they direction is fixed in the head holder 30. At this time, a spring provided in the head holder door 31 urges the print head 8 in the +y direction. That is, the front positioning member 38 and the spring provided in the head holder door 31 are features for positioning the print head 8 in the y direction in the head holder 30.

Figure 14A:
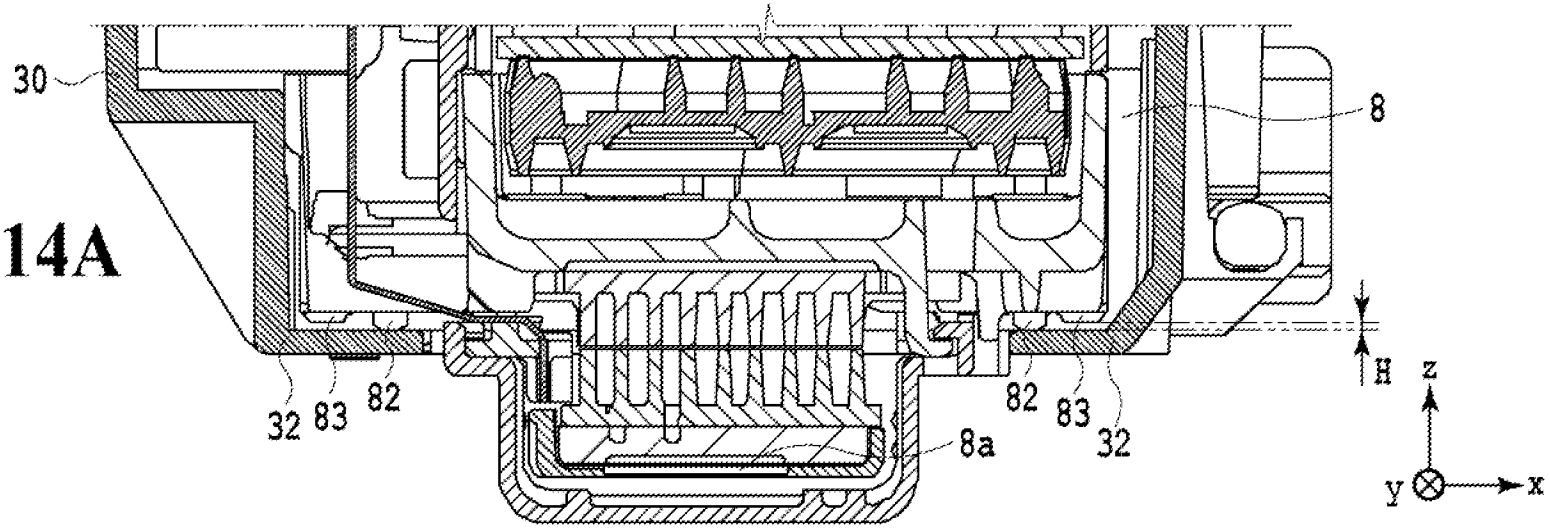
FIGS. 14A and 14B are enlarged cross-sectional views of the print head and the head holder.
Figure 14B:
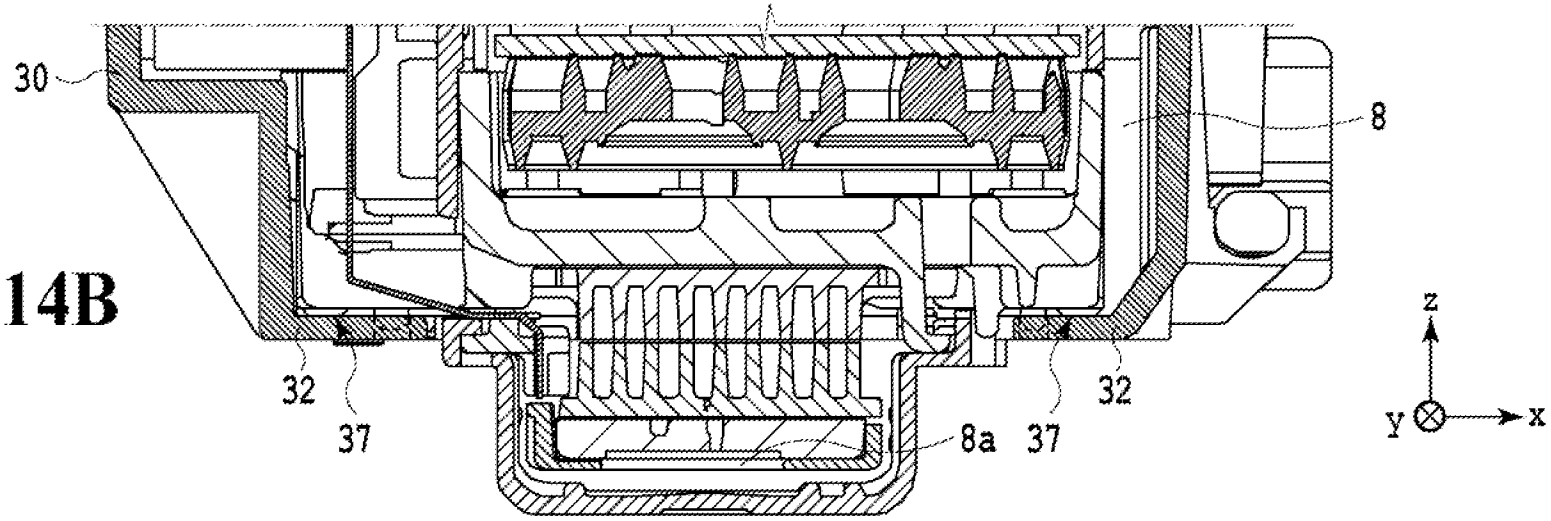

FIGS. 14A and 14B are enlarged cross-sectional views of the print head 8 and the head holder 30. FIG. 14A shows a state where the print head 8 is being inserted. FIG. 14B shows a state where the print head 8 has been inserted and positioned. On the bottom of the base plate 80 of the print head 8, both ends of the ejection opening surface 8*a* in the ±x direction are provided with a sliding portion 82 protruding relatively largely and a landing portion 83 protruding relatively slightly and having a flat plane, which are adjacent to each other.

In the case of inserting the print head 8, as shown in FIG. 14A, the sliding portion 82 is in contact with and the landing portion 83 is not in contact with the sliding bottom surface 32 of the head holder 30. As the insertion advances, the sliding portion 82 falls into the cut-off portion 39 described with reference to FIG. 13 and the landing portion 83 lands on the landing surface 37 of the sliding bottom surface 32 as shown in FIG. 14B. The contact between the landing portion 83 and the landing surface 37 completes the positioning in the z direction in the head holder. That is, the print head 8 lands on a position lower than the height during insertion by H with respect to the head holder 30.

In the present embodiment, the sliding bottom surface 32 of the head holder 30 is formed of aluminum. Accordingly, if the sliding of the sliding portion 82 is repeated each time the print head 8 is replaced, the sliding bottom surface 32 may wear out and the positioning accuracy in the z direction may decrease. The print head 8 can be smoothly inserted into the head holder 30 and accurately positioned by individually providing the sliding portion 82 for sliding and the landing portion 83 for positioning like the present embodiment.

Figure 15A:
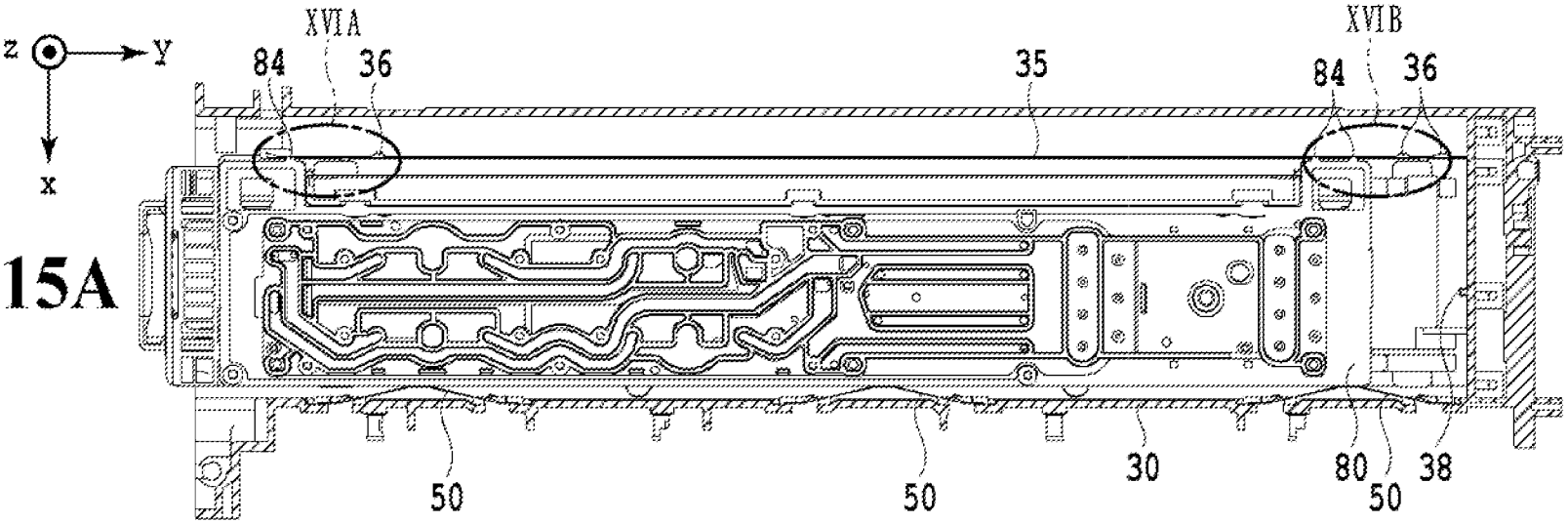
FIGS. 15A and 15B are top views of the head holder with the print head inserted.
Figure 15B:
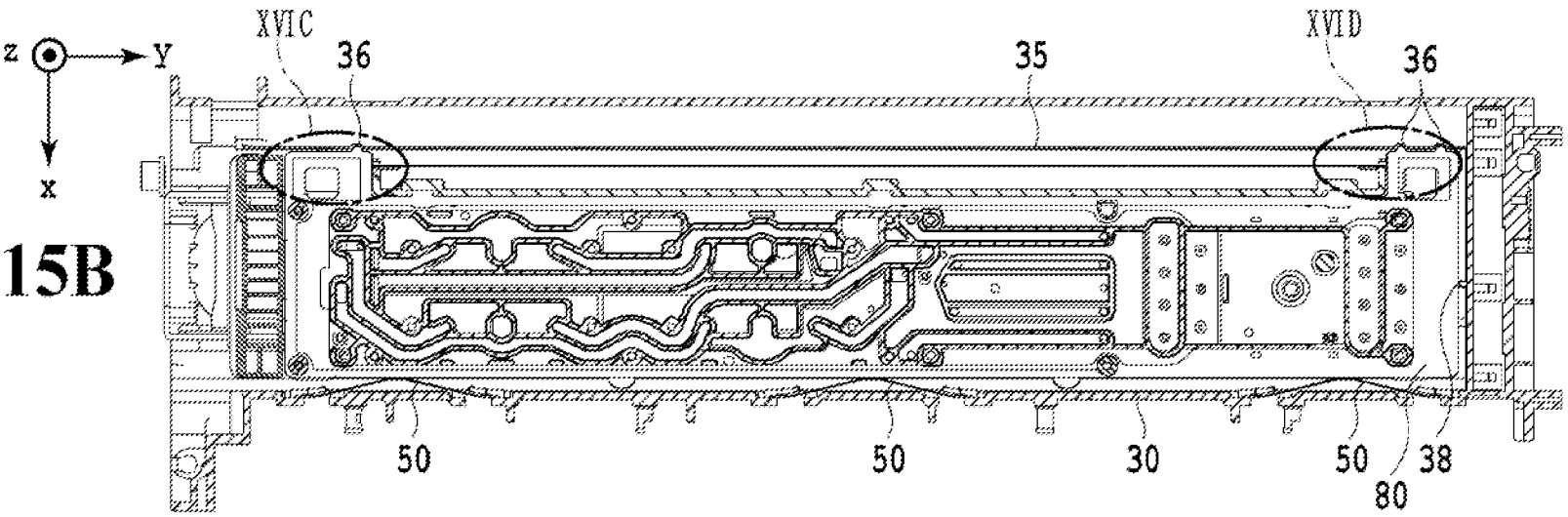

FIGS. 15A and 15B are top views of the head holder 30 with the print head 8 inserted. FIG. 15A shows a state where the print head 8 is being inserted. FIG. 15B shows a state where the print head 8 has been inserted and positioned. A protrusion 84 is provided in both ends in the longitudinal direction of the surface of the base plate 80 of the print head 8 facing the sliding side surface 35. A recess 36 for avoiding the protrusion 84 is provided in both ends of the sliding side surface 35 in the longitudinal direction.

Under the configuration described above, if the print head 8 is inserted into the head holder 30, the print head 8 is urged in the −x direction in the drawing by the urging member 50, the protrusions 84 contact the sliding side surface 35, and the print head 8 moves in the +y direction while being guided by the sliding side surface 35. FIG. 15A shows a state in the middle of the insertion. In FIG. 15A, the front end of the print head 8 is not in contact with the front positioning member 38.

FIG. 15B shows a state where the insertion has been completed. In FIG. 15B, the protrusions 84 are accommodated in the recesses 36 and the front end of the print head 8 in the direction of insertion is in contact with the front positioning member 38.

Figure 16A:
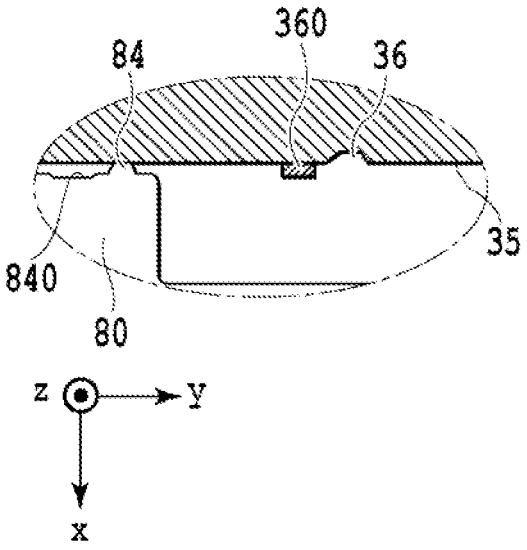
FIGS. 16A to 16D are enlarged views showing positioning states on a side surface.
Figure 16B:
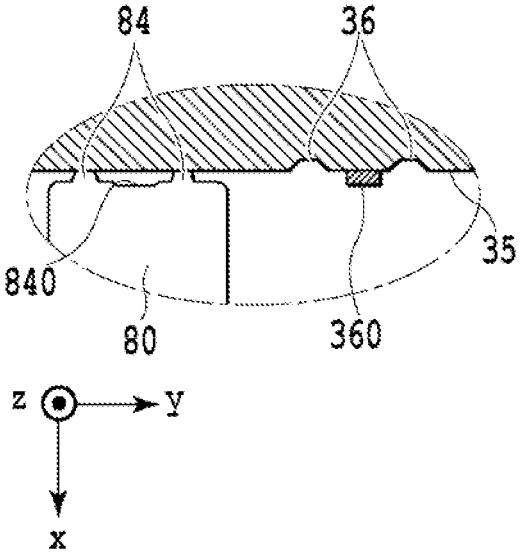

FIGS. 16A to 16D are enlarged views showing the peripheries of the protrusions 84 and the positioning ribs 360 shown in the left and right in FIGS. 15A and 15B. FIGS. 16A and 16B show the peripheries of the protrusions 84 in a sliding state. The protrusions 84 are urged in the −x direction by the urging member 50 and moved rightward in the drawings while receiving a resisting force from the sliding side surface 35 in contact with the protrusions 84.

Figure 16C:
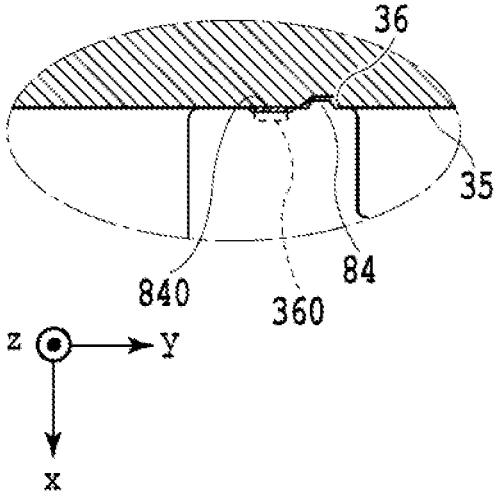
Figure 16D:
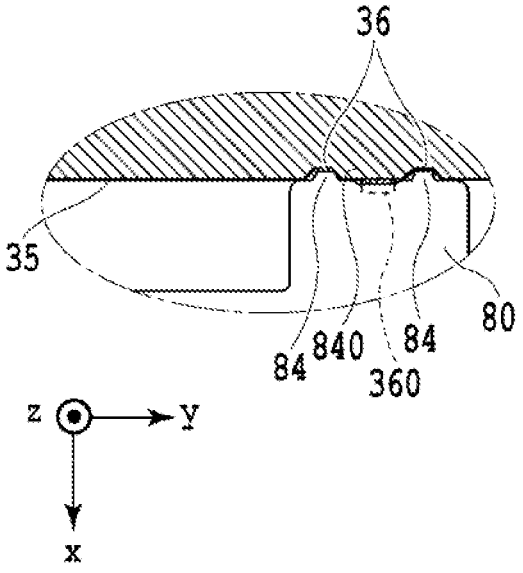

FIGS. 16C and 16D show the protrusions 84 and the recesses 36, which have been positioned by the positioning ribs 360. The recess 360 is configured to avoid the protrusion 84 such that the protrusion 84 urged in the −x direction by the urging member 50 does not contact the recess 360. The print head 8 is positioned in the x direction by contact between a contacting surface 840 of the print head 8 and the positioning rib 360.

As described above, according to the present embodiment, the print head 8 is guided into the head holder 30 by sliding of the sliding portion 82 and protrusion 84 of the print head 8 along the sliding bottom surface 32 and sliding side surface 35 of the head holder 30, respectively. The print head 8 is positioned in the z direction by contact between the landing portion 83 of the print head 8 and the landing surface 37 of the head holder 30, and is positioned in the x direction by contact between the contacting surface 840 of the print head 8 and the positioning rib 360. After the completion of the insertion, a user closes the head holder door 31, whereby the end of the print head 8 in the depth direction is pushed against the front positioning member 38 by the spring provided in the head holder door 31 and the print head 8 is positioned in they direction.

As described above, according to the present invention, the print head can be attached to a suitable position with a simplified configuration while suppressing contamination or damage caused by contact with the ejection opening surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-151445, filed Aug. 10, 2018, which is hereby incorporated by reference wherein in its entirety.

What is claimed is:

1. An inkjet printing apparatus comprising:

a print head comprising an ejection opening surface on which ejection openings configured to eject ink are arrayed, wherein the ejection opening surface can be protected by a protective member detachably attached to the print head; and a head holder configured to hold the print head inserted in a first direction, wherein the head holder includes (1) a guide portion configured to guide the print head to which the protective member is attached in the first direction and (2) a restricting portion configured to restrict the protective member from being inserted downstream of a predetermined position in the first direction.

2. The inkjet printing apparatus according to claim 1, wherein the protective member comprises a locking member engageable with an engagement portion provided in the print head, and wherein the head holder includes a pressing member configured to be capable of disengaging an engagement between the locking member and the engagement portion by contacting the locking member.

3. The inkjet printing apparatus according to claim 2, wherein the locking member contacts the pressing member, thereby being retracted from a path through which the engagement portion proceeds along with insertion of the print head.

4. The inkjet printing apparatus according to claim 2, wherein the pressing member disengages the engagement before insertion of the print head is completed.

5. The inkjet printing apparatus according to claim 1, wherein the protective member includes a stopper configured to restrict sliding of the protective member on the print head in a state which the protective member is attached to the print head.

6. The inkjet printing apparatus according to claim 1, wherein the protective member includes a gripping portion configured to allow a user to pull the protective member from the head holder after inserting of the print head is completed.

7. The inkjet printing apparatus according to claim 1, wherein the head holder includes:

a landing surface on which a landing portion of the print head lands, and wherein the print head is positioned in a direction of gravity by landing of the landing portion on the landing surface.

8. The inkjet printing apparatus according to claim 1, wherein the head holder includes:

an urging member configured to urge the print head against a side surface of the head holder, and wherein the print head is positioned in a second direction by coming into contact with the side surface, the second direction intersecting with the first direction and a direction of gravity.

9. The inkjet printing apparatus according to claim 1, wherein the head holder includes:

a positioning member configured to contact a downstream end of the print head in the first direction; and a cover member configured to cover an opening into which the print head is inserted, and wherein the print head is positioned in the first direction in a case where the cover member covers the opening and while the downstream end of the print head is in contact with the positioning member.

10. The inkjet printing apparatus according to claim 1, wherein the protective member is detachable from the print head after insertion of the print head is completed.

11. The inkjet printing apparatus according to claim 1, wherein the ejection openings are arrayed in an area corresponding to a width of a printing medium.

12. A print head used for an inkjet printing apparatus, the inkjet printing apparatus including a head holder configured to hold the print head inserted in a first direction, the print head comprising:

an ejection opening surface on which ejection openings configured to eject ink are arrayed, wherein the ejection opening surface can be protected by a protective member detachably attached to the print head, wherein the head holder includes (1) a guide portion configured to guide the print head to which the protective member is attached in the first direction and (2) a restricting portion configured to restrict the protective member from being inserted downstream of a predetermined position in the first direction.

13. The print head according to claim 12, further comprising:

an engagement portion engageable with a locking member provided in the protective member, wherein the head holder includes a pressing member configured to be capable of disengaging an engagement between the locking member and the engagement portion by contacting the locking member.

14. The print head according to claim 13, wherein the pressing member disengages the engagement before insertion of the print head into the head holder is completed.

15. The print head according to claim 12, wherein the ejection openings are arrayed in an area corresponding to a width of a printing medium.

16. A protective member detachably attached to a print head used for an inkjet printing apparatus, the inkjet printing apparatus including a head holder configured to hold the print head inserted in a first direction, the print head including an ejection opening surface on which ejection openings configured to eject ink are arrayed, wherein the protective member protects the ejection opening surface in a state of being attached to the print head, and wherein the head holder includes (1) a guide portion configured to guide the print head to which the protective member is attached in the first direction and (2) a restricting portion configured to restrict the protective member from being inserted downstream of a predetermined position in the first direction.

17. The protective member according to claim 16, further comprising:

a locking member engageable with an engagement portion provided in the print head, wherein the head holder includes a pressing member configured to be capable of disengaging an engagement between the locking member and the engagement portion by contacting the locking member.

18. The protective member according to claim 16, further comprising:

a stopper configured to restrict sliding of the protective member on the print head in a state of being attached to the print head.

19. The protective member according to claim 16, further comprising:

a gripping portion configured to allow a user to pull the protective member from the head holder after inserting of the print head into the head holder is completed.

20. The protective member according to claim 16, wherein the protective member is detachable from the print head after insertion of the print head into the head holder is completed.

* * * * *